US005249902A

United States Patent [19]

Stankiewicz

[11] Patent Number: 5,249,902

[45] Date of Patent: Oct. 5, 1993

[54] LOOSE-LEAF BINDER ASSEMBLY PROCESS AND APPARATUS

[75] Inventor: Casimir J. Stankiewicz, Easthampton, Mass.

[73] Assignee: The Holson Burnes Company, North Smithfield, R.I.

[21] Appl. No.: 903,917

[22] Filed: Jun. 25, 1992

[51] Int. Cl.[5] ..... B42B 5/08

[52] U.S. Cl. ..... 412/7; 412/38; 412/42; 402/34; 402/80 R; 29/771

[58] Field of Search ..... 412/4, 7, 9, 14, 20, 412/33, 38, 42; 402/26, 31, 34, 80 R; 29/237.5, 771; 271/12, 13, 232, 241

[56] References Cited

U.S. PATENT DOCUMENTS

| | | | |
|---|---|---|---|
| 2,051,617 | 1/1935 | Newman | 129/24 |
| 3,263,687 | 8/1966 | Weichert | 129/24 |
| 3,606,557 | 12/1971 | Schade | 402/31 |
| 4,281,445 | 8/1981 | Barber et al. | 402/80 R |
| 4,537,545 | 8/1985 | Kunzmann | 412/7 |
| 4,552,478 | 11/1985 | Cohen | 402/39 |
| 4,678,357 | 7/1987 | Kissel et al. | 402/39 |
| 5,069,568 | 12/1991 | Acker | 402/73 |

*Primary Examiner*—Mark Rosenbaum
*Assistant Examiner*—S. Thomas Hughes
*Attorney, Agent, or Firm*—St. Onge Steward Johnston & Reens

[57] ABSTRACT

An improved method and apparatus enable automated assembly of loose-leaf books, preferably photo albums from snap-ring binders of the slant D configuration and pages with peel-back overlays on mounting sheets. The apparatus comprises: a binder conveyor adapted to position a binder at an assembly station such that an upstanding segment of each ring in open position extends upward and has a vertical projection smaller than that of the holes in the pages; a page support positioned above the binder conveyor and having openings therein adapted for alignment with the holes in the pages; and a binder lift mechanism adapted to vertically lift a binder such that a segment of each ring is moved through the openings in the page support and the holes in the pages supported thereby. The process is automated and employs two linearly moving conveyors which intersect to enable positioning the binder with open ring elements at the assembly station.

14 Claims, 8 Drawing Sheets

LOOSE-LEAF BINDER ASSEMBLY PROCESS AND APPARATUS

DESCRIPTION

1. Cross-referenced to Related Application

U.S. patent application Ser. No. 07/830,394 filed claims related subject matter.

2. Technical Field

The invention relates to the assembly of loose-leaf books, such as photo albums and the like, by automated equipment.

Marketing complete books for specific purposes, such as a school notebook with subject dividers or a photo album including pages with peel-back plastic overlays, has been found convenient for both the consumer and the store keeper. Many loose-leaf books are assembled at a factory by inserting hole-punched pages in binders and packaging them there for distribution and sale. Unfortunately, the assembly process is labor intensive.

A variety of binder mechanisms are known. One type which has achieved wide popularity is referred to as a snap-ring binder and employs two or more openable ring elements extending from a base panel. Typically, the base panel is attached to a cover assembly having foldable outer covers to protect hole-punched sheets held by the ring elements. The ring elements are typically formed of two mating ring segments, the tops of which can be moved toward and away from each other to open and close them.

The typical mating ring segments of snap-ring binders employed for books intended for marketing as complete units makes inserting punched pages difficult. This limits production in a factory or other high-volume assembly setting to manual insertion of the pages, no more than a few at a time. This has been associated with occupational and economic difficulties. Workers are required to repeatedly move their hands and wrists in a tucking motion. This work is not only tediously repetitive, it is slow and economically inefficient.

There is a present need for an improved process and apparatus for assembling loose-leaf books.

BACKGROUND ART

Snap-ring binders are known with a variety of ring element and binder mechanism structures. Early versions, like those available today, employed two or more openable ring elements extending from a base panel. In U.S. Pat. No. 2,051,617, Newman showed the typical circular ring elements, each comprised of semicircular mating ring segments.

Popular snap-ring binder assemblies employ the mating ring segments affixed to carrier rails which are toggled between open and closed positions within a partially-enclosing spring base panel. Newman shows the spring base panel below the carrier rails, but it is more typical today to have the spring base panel on top as a cover for the carrier rails with the ring segments extending through openings in it. In U.S. Pat. No. 3,263,687, Weichert shows a hybrid configuration, using the spring base panel as a top cover for the carrier rails, with the ring segments on one side extending through it and those on the other extending around it from underneath.

The spring base panel is usually attached to a foldable cover assembly to protect hole-punched sheets held by the ring elements. Typically, the foldable cover will have a top section, a bottom section, and a spine connecting the two. The binder assembly can be attached to the spine as shown by Acker in U.S. Pat. No. 5,069,568, to the back section as shown in Weichert above or U.S. Pat. No. 4,552,478 to Cohen, or in a special relationship as shown for example by Schade in U.S. Pat. No. 3,606,557 with the ring elements securing front and back portions of a spine member for added strength for large numbers of pages.

An array of shapes for ring elements is known, including the basically circular ones shown for example by Newman above, and half-circular and half-straight segments as shown by Kissel et al in U.S. Pat. No. 4,678,357, and the half-circular and half-squared-C shapes of Weichert and Cohen above. It is typical for the ring elements of assembled binders to be configured such that the projection of the mating ring segment proposed for insertion is wider than the holes in the pages along the line of intended insertion. This arrangement makes automated assembly difficult, and there is a need for an improved process and apparatus for assembling books by automated assembly of page sets into snap-ring binders.

BRIEF DESCRIPTION OF THE DRAWINGS

The invention will be better understood and its advantages will be more fully appreciated from the following detailed description, especially when read in light of the accompanying drawings, wherein.

DISCLOSURE OF INVENTION

It is an object of the invention to provide both an improved method and an improved apparatus for assembling loose-leaf books.

This and other objects are accomplished by the invention which enables automated assembly of books of the type comprised of a snap-ring binder assembly having a plurality of ring elements formed by two rows of mating ring segments, a stack of pages with aligned holes, and a foldable cover configured to overlay the binder assembly and the stack of pages held by the ring elements. The preferred type of binder is of the slant D configuration with three ring elements extending from a base panel, and with the base panel being secured to the back panel of a foldable cover comprising a front panel, the back panel and a spine connecting the front and back panels. Also preferably, the loose-leaf book is a photo album and the pages comprise a mounting sheet with adhesive applied thereto and overlays adapted to peel-back from the mounting sheet.

Briefly, the apparatus comprises: a binder conveyor adapted to position a binder at an assembly station such that an upstanding segment of each ring in open position extends upward and has a vertical projection smaller than that of the holes in the pages; a page support positioned above the binder conveyor and having openings therein adapted for alignment with the holes in the pages; and a binder lift mechanism adapted to vertically lift a binder such that a segment of each ring is moved through the openings in the page support and the holes in the pages supported thereby.

The process comprises: linearly advancing a binder toward an assembly station; positioning the binder with open ring elements at the assembly station; linearly advancing a stack of pages to a position above the intersection with the line of movement of the binder; positioning the stack of pages over the binder such that upstanding ring segments are aligned with the holes at said assembly station; raising the binder to insert the upstanding ring segments into the holes; closing the ring elements; and withdrawing the binder from the assembly station. Preferably, the stack of pages is moved along a line parallel to the line of movement of the binder to finally position the pages over the binder. It is also preferred to assure alignment of the holes for all of the pages in the stack by inserting a pin through one hole to at least the depth of the stack, and to also hold down the pages in the stack during insertion of the upstanding ring elements.

Industrial applicability

Figure 1:
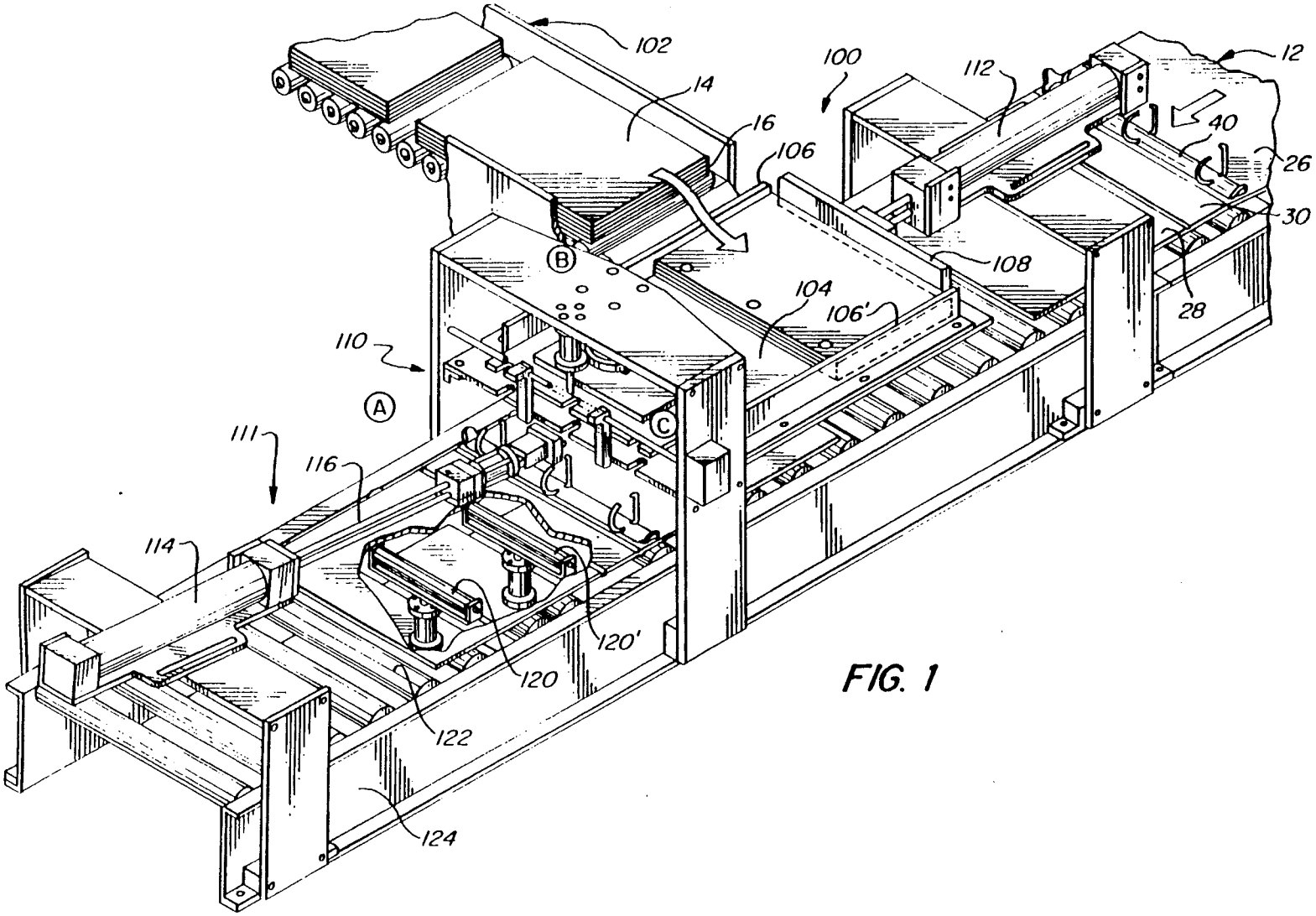
FIG. 1 is a perspective view of a preferred apparatus for assembling a book according to the invention, and shows a binder with rings open awaiting insertion of a set of pages which is in position for the start of the assembly process.

FIG. 1 is a perspective view showing an apparatus 100 according to the invention which is capable of feeding individual binders 12 and stacks 14 of pages 16 i.e., sets of pages, having holes 18 therein. This figure shows the starting point in the assembly process; however, to better understand the preferred relation of the binder and pages, reference can be made to FIG. 5 which better shows the detail of the binder structure as it relates to the actual assembly process.

Figure 5:
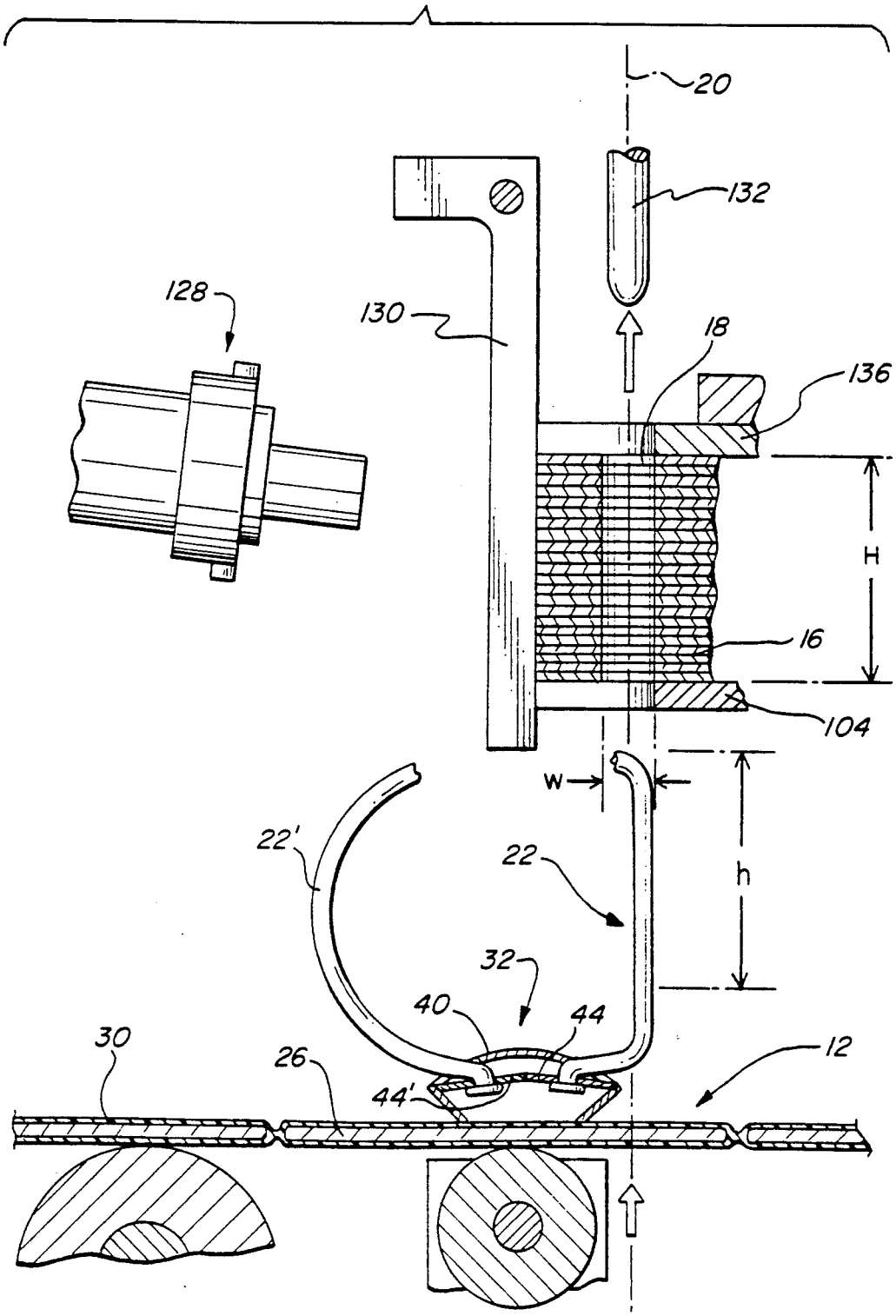
FIG. 5 is an enlarged cross-sectional view, showing the detail of withdrawal of the alignment means shown in FIG. 4.

FIG. 5 shows holes 18 of all pages 16 in a set 14 to be aligned, such as along center-line 20, which also defines the line of insertion of upstanding ring-segments 22 into the aligned holes 18. The total or maximum transverse dimension (w) of the upper portion 24 of ring segment 22, including at least a stack-retaining portion of height h equal to the thickness H of stack 14 of pages, is smaller than the diameter of hole 18. This permits passage of the upstanding ring segments 22 through the aligned holes 18 for the entire thickness H of the stack 14.

Standard holes for binder pages are from 5 to 10 mm, e.g., 7.9 mm, in diameter. These holes are typically formed by punching or drilling. Preferably, the loose-leaf book is a photo album and the pages comprise a mounting sheet with adhesive applied thereto and overlays adapted to peel-back from the mounting sheet.

The snap-ring binder 12 has a back cover 26, a front cover 28, and a spine 30 connecting the front and back covers. A snap-ring assembly 32 is shown in its preferred form, attached to the back cover 26. In other embodiments, it can be attached to the spine. The binder is shown in open position to facilitate insertion of the pages 16 as a stack 14. After assembly is completed, the spine 30 and top cover portion 28 can be wrapped up and around the snap-ring assembly and any pages included therein.

The snap-ring assembly 32 is shown in FIG. 1 to include three open snap ring elements. It is typical to employ anywhere from two to about five of these openable ring elements extending from a base panel 40. Typically, the base panel is attached to the cover with two or more spun rivets or other suitable fasteners (not shown).

The mating ring segments 22 and 22, are affixed to carrier rails 44 and 44' as shown in cross section in FIG. 5, which are enclosed by spring metal base panel 40. The tops of the ring segments can be moved toward and away from each other to open and close the ring element. The combined shape of a closed ring is shown in its preferred form as a slant D ring.

The carrier rails 44 and 44' are typically slightly wider than the interior of the spring base panel 40 and are positioned edge-to-edge at a bias. As the mating ring segments (e.g., 22 and 22') are moved, either toward or away from one another, the spring base panel 40 is flexed to permit the carrier rails to be moved past planar alignment and to the bias opposite the original position. This provides a snapping action, braces the rings in open or closed position, and causes all of the rings to operate together.

The apparatus for inserting hole-punched pages into a snap-ring binder to form a book according to the invention, is greatly improved as compared to the prior art.

FIG. 1 shows the apparatus at the start of an assembly operation. Page set conveyor 102 begins to move a single set 14 of pages onto stack support platen 104 where it is positioned between guide rails 106 and 106'. A set of pages is shown in position for pusher bar 108 to advance the set toward assembly station 110, by actuation of pneumatic cylinder 112. The cylinders are commercially available.

On the end of the apparatus opposite the cylinder 112, is a cylinder 114 which is capable of moving rods 116 and associated gripping means to and from the assembly station 110. A binder conveyor means 111 linearly advances a binder, preferably with open ring elements, toward assembly station 110. A set of lift rollers 120 and 120' is shown by partially cutting away the binder cover and the conveyor rollers 122. The conveyor 111 itself is comprised of a plurality of these rollers 122 held in frame 124 and moved in unison by belt drive or other suitable means. The conveyor means 102 enables the linear advancement of a stack of pages to a position above the intersection with the line of movement of the binder on conveyor Il.

The apparatus will include means for positioning the binder with open ring elements at the assembly station. The conveyor 111 will move the binder to the station and will stop it there in the proper position when means such as photo cells indicate proper alignment.

The various process steps as described herein are shown in the figures in the sequence in which they occur. These can be controlled by any computer or other controller effective to initiate the movements noted when the workpieces are in the correct positions. A series of photocells is located to sense the presence of workpieces at designated stations to control operation of the equipment. For example, a photocell can be located at position A to detect the presence of the album, one at position B can be employed to detect a page set on the conveyor 102, and a third at position C can be employed to detect the presence of a page set at assembly station 110.

Figure 2:
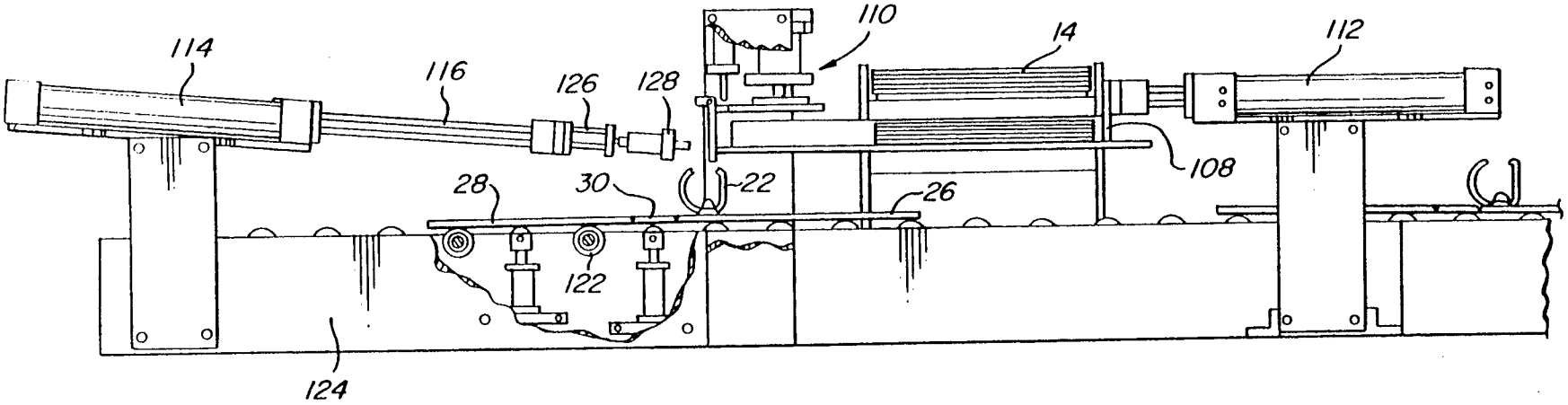
FIG. 2 is a side elevation view, partially broken away, of the apparatus at the same stage of operation as shown in FIG. 1.
Figure 8:
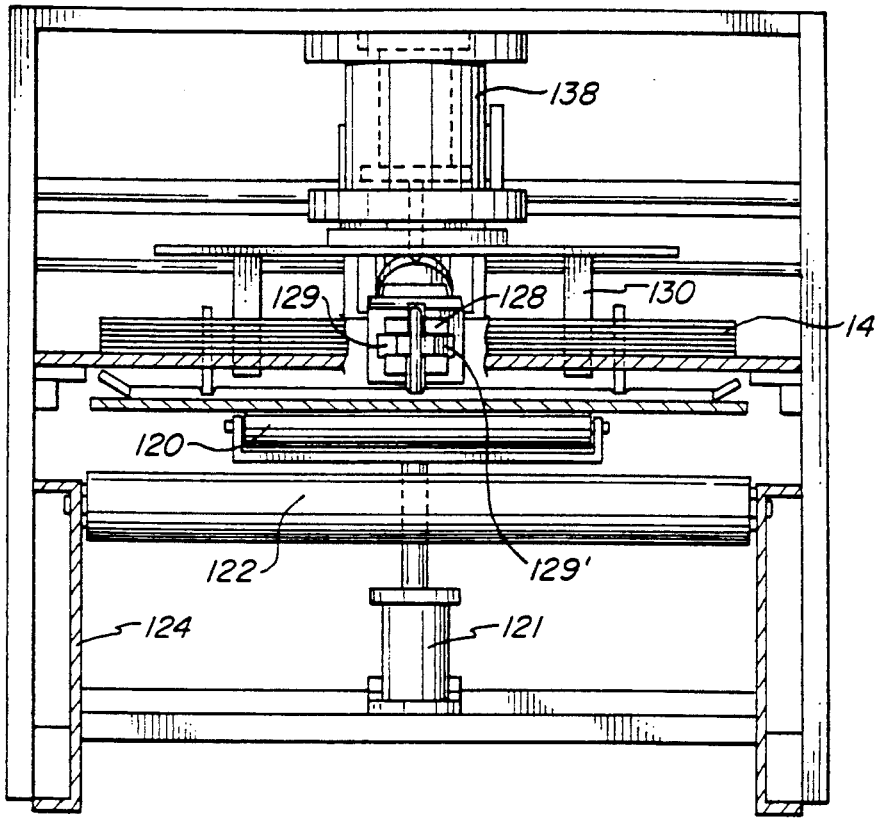
FIG. 8 is a cross-sectional view taken along line 8—8 in FIG. 6, and partially cut away to show ring gripper means.

FIG. 2 illustrates essentially the same process step as shown in FIG. 1, but does so in a side elevation view, which is partially cut away to show lift rollers 120 and 120' and their relationship to conveyor rollers 122. This drawing shows the gripping means which are associated with rods 116 to comprise a secondary pneumatic cylinder 126 which actuates gripper 128. This cylinder can be of the same kind as described above. The gripper 128 can be a commercially available air chuck. Gripper 128 includes opposed J-shaped elements 129 and 129' which are moved between open and closed (gripping) positions by the air chuck or other suitable means (see FIG. 8 also). Gripper 128 is adapted to grasp onto ring segments 22' when the ring elements are in the open position, and to maintain the grasp during closing and during withdrawal of the completed book from the assembly station 110. This operation will be described in greater detail with reference to the other figures.

Figure 3:
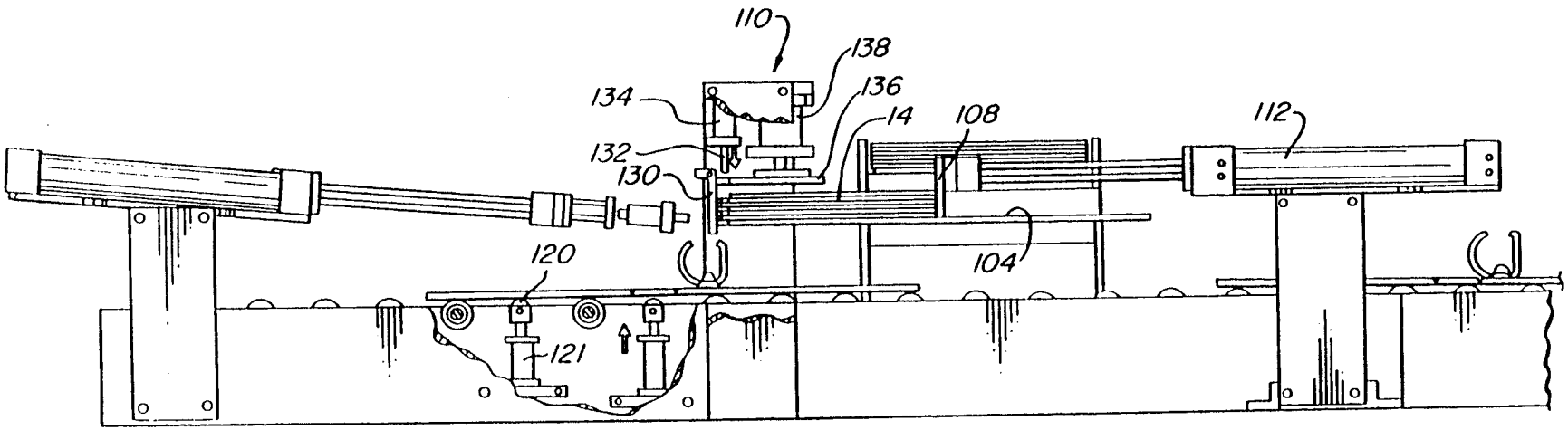
FIG. 3 is a side elevation view, similar to FIG. 2, but showing a set of pages moved to the assembly station.

A next stage in the operation of the apparatus is shown in FIG. 3. The assembly operation is facilitated by the provision of means for positioning the stack of pages over the binder such that the upstanding ring segments are aligned with the holes at the assembly station. FIG. 3 shows a page set 14 which has been advanced to assembly station 110 by pusher bar 108, which in turn was moved by actuation of pneumatic cylinder 112. The page set 114 was guided laterally by rails 106 and 106' (not shown in this Figure) to come to a stop at gate means 130. At this position, a center hole locator pin 132, actuated by pneumatic cylinder 134, and hold-down platen 136, actuated by pneumatic cylinder 138, are ready to begin movement in the direction shown by the arrow in FIG. 3.

Figure 4:
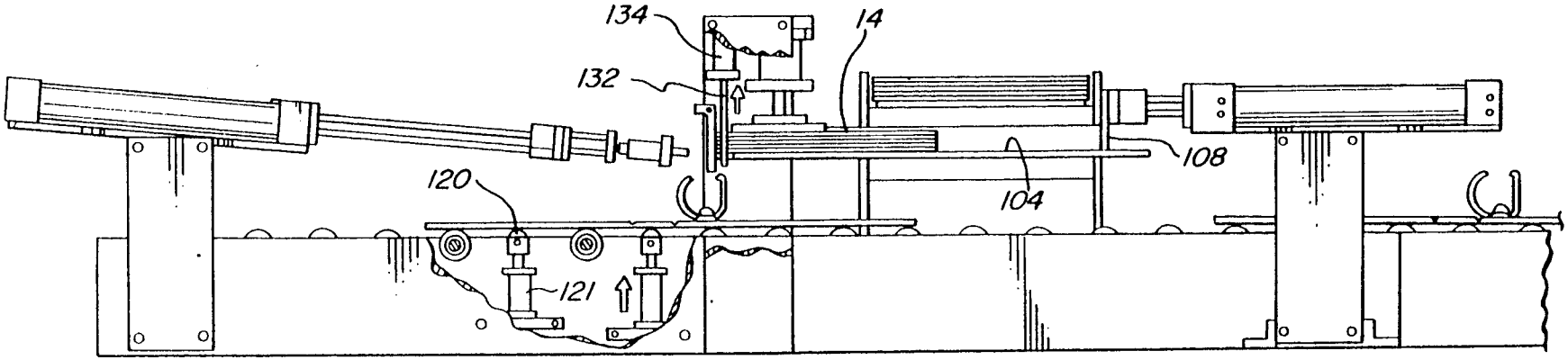
FIG. 4 is also a side elevation view, but showing the holes in a set of pages being aligned for assembly with the binder.

Reference to FIG. 4 shows the center hole locator pin 132 and hold-down platen 136 to have been moved to their full downward extents. The locator pin 132 is aligned within the center holes 18 in the pages in the page set 14. The hold-down platen 136 firmly holds the page set 14 in place. At this position, the locator pin cylinder 134 and a cylinder 121 for each lift roller 120 are actuated for movement in the directions indicated by the respective arrows shown in FIG. 4. This is the start of the actual insertion process which can be seen in greater detail in FIG. 5. The upstanding ring segment 22 will be moved upwardly through aligned holes 18.

Figure 6:
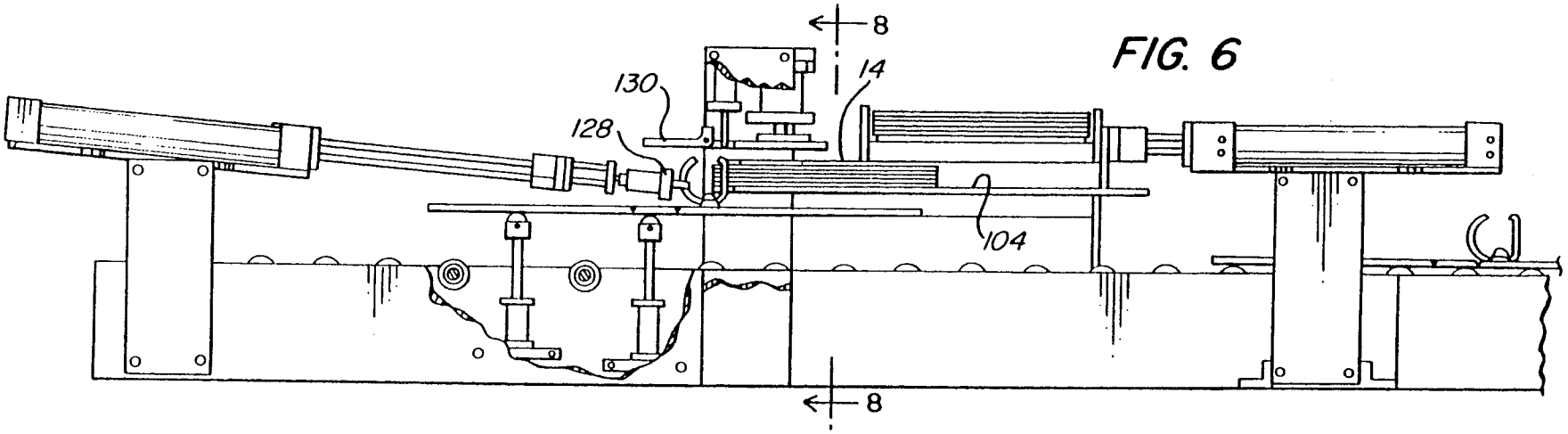
FIG. 6 is a side elevation view, partially cut away to show the ring binder structure in elevated position following insertion of ring elements into holes in the pages.

FIG. 6 shows the completion of upward withdrawal of the center hole locator pin 132 and the hold-down platen 136. At this point, lift rollers 120 and 120' are still elevated and the page set 14 is still supported on support platen 140. Gate 130 has been raised and gripper 128 has been actuated to grasp ring segments 22'.

Figure 7:
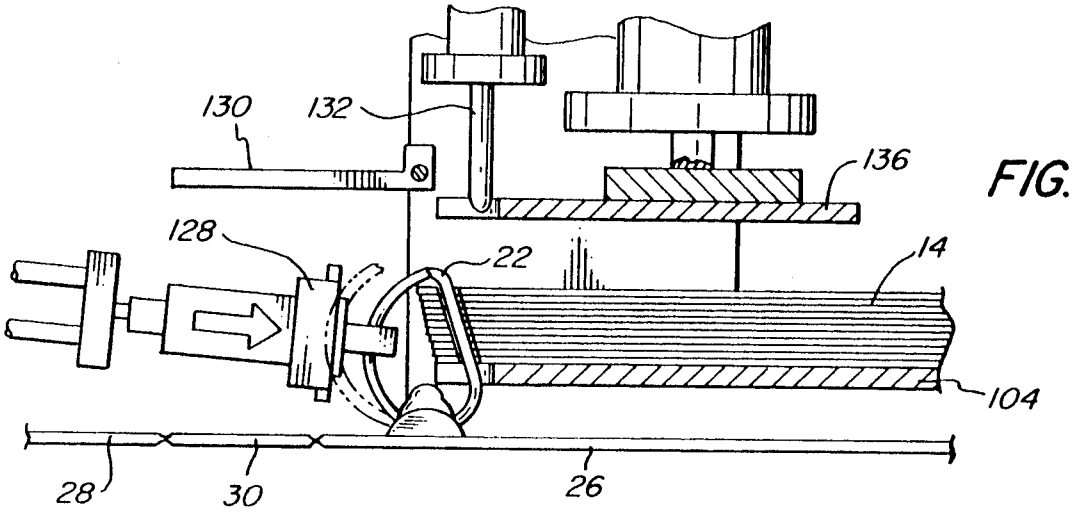
FIG. 7 is an expanded side view which shows the ring elements being closed.

Reference to FIG. 7 shows gripper 128 moved forward to close the mating ring segments of the ring elements. Closing one ring will cause all the rings to close because of the snap-ring binder construction. A better view of the gripper 128 can be seen in FIG. 8. Upon closing the ring elements, the lift rollers 120 and 120' are lowered, and the assembled book is pulled from support platen 104 by actuating cylinder 114. The book is free to slide off platen 140 because gates 130 have been raised previously.

Figure 9:
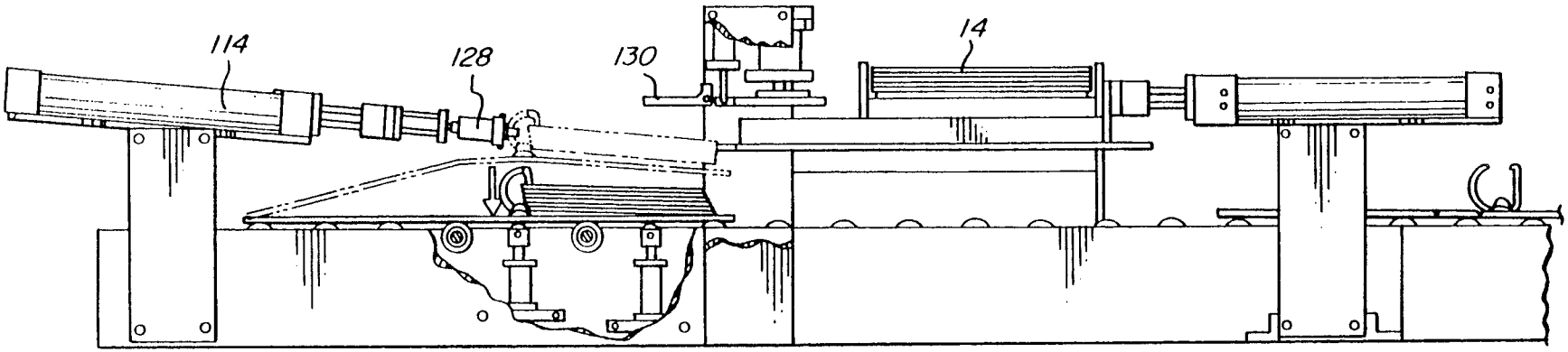
FIG. 9 is a side elevation view showing the completion of a cycle of operation.

Following withdrawal of the book from platen 104, it can be held by gripper 128 above the conveyor until the next operation in the sequence is begun. FIG. 9 shows (in phantom) lines a book withdrawn and suspended. Gripper 128 is then actuated to release the ring segment 22' and permit the book to drop onto the conveyor, to complete the operation. The sequence is then repeated for assembly of further books.

The above description is for the purpose of teaching the person of ordinary skill in the art how to practice the invention, and is not intended to detail all of those obvious modifications and variations of it which will become apparent to the skilled worker upon reading the description. It is intended, however, that all such obvious modifications and variations be included within the scope of the invention, which is defined by the following claims. The claims are meant to cover the claimed elements and steps in any arrangement or sequence which is effective to meet the objectives there intended, unless the context specifically indicates the contrary.

I claim:

1. A process for forming a loose-leaf book by assembling a stack of pages into a snap-ring binder, wherein each page has a plurality of holes which are aligned with holes in the other pages in the stack and the binder has a plurality of ring elements each, when open, having an upstanding ring segment configured such that its projection along a line of insertion is smaller than the holes in the pages, the process comprising:

advancing a binder on a line of movement toward an assembly station;

positioning the binder with open ring elements at the assembly station;

linearly advancing a stack o pages to a position which intersects with but is above the line of movement of the binder;

positioning the stack of pages over the binder such that its upstanding ring segments are aligned with the holes in the stack of pages at said assembly station;

raising the binder thereby inserting its upstanding ring segments into the holes;

closing the ring elements; and withdrawing the binder with the stack of pages from the assembly station.

2. A process according to claim 1 which includes: advancing the stack of pages along a line parallel to the line of movement of the binder and positioning the pages over the binder.

3. A process according to claim 1 wherein alignment of the holes for all of the pages in the stack is assured by inserting a pin through one hole of each page in the stack.

4. A process according to claim 1 which includes holding down the pages in the stack during insertion of the upstanding ring elements.

5. A process according to claim 1 wherein: the binder is of the slant D configuration with three ring elements extending from a base panel, and the base panel is secured to the back panel of a foldable cover comprising a front panel, the back panel and a spine connecting the front and back panels.

6. A process according to claim 1 wherein the loose-leaf book is a photo album and the pages comprise a mounting sheet with adhesive applied thereto and overlays adapted to peek-back from the mounting sheet.

7. An apparatus for forming a loose-leaf book by assembling a stack of pages into a snap-ring binder, wherein each page has a plurality of holes which are aligned with holes in the other pages in the tack and the binder has a plurality of ring elements, each when open, having an upstanding ring segment configured such that its projection along a line of insertion is smaller than the holes in the pages, the apparatus comprising:

conveyor means for advancing a binder along a line of movement toward an assembly station;

means for positioning the binder with open ring elements at the assembly station;

means for linearly advancing a stack of pages to a position which intersects with but is above the line of movement of the binder;

means for positioning the stack of pages over the binder such that the upstanding ring segments are aligned with the holes at said assembly station;

means for raising the binder to insert upstanding ring segments into the holes; and means for closing the ring elements.

8. An apparatus according to claim 7 wherein the means for positioning the stack of pages over the binder includes means to move the stack of pages along a line parallel to the line of movement of the binder to finally position the pages over the binder.

9. An apparatus according to claim 7 which further includes: pin means for aligning all of the pages in the stack, and means for moving said pin means through one hole to at least the depth of the stack.

10. An apparatus according to claim 7 which further includes means for holding down the pages in the stack during insertion of the upstanding ring elements.

11. An apparatus for assembling pages with holes into a snap-ring binder comprising:

a binder conveyor means for positioning a binder at an assembly station such that a segment of each ring in open position extends upward and has a vertical projection smaller than that of the holes in the pages;

a page support platen above said binder conveyor means and having openings therein adapted for alignment with the holes in the pages; and a binder lift mechanism adapted to vertically lift a binder such that a segment of each ring is moved through the openings in the page support and the holes in the pages supported thereby.

12. An apparatus according to claim 11 which further includes:

page conveyor to position the stack of pages on the support platen; and means for closing the ring elements.

13. An apparatus according to claim 11 which further includes: pin means for aligning all of the pages in the stack, and means for moving said pin means through one hole to at least the depth of the stack.

14. An apparatus according to claim 11 which further includes means for holding down the pages in the stack during insertion of the ring elements.

* * * * *